United States Patent [19]

Takigawa

[11] Patent Number: 4,869,644

[45] Date of Patent: Sep. 26, 1989

[54] BLADES FOR PROPELLER FAN

[75] Inventor: Kazunori Takigawa, Numazu, Japan

[73] Assignee: Usui Kokusai Sangyo Kabushiki Kaisha, Nagasawa, Japan

[21] Appl. No.: 219,316

[22] Filed: Jul. 15, 1988

Related U.S. Application Data

[63] Continuation of Ser. No. 134,007, Dec. 17, 1987, abandoned, which is a continuation of Ser. No. 27,653, Mar. 19, 1987, abandoned.

[30] Foreign Application Priority Data

| | | | |
|---|---|---|---|
| Mar. 22, 1986 | [JP] | Japan | 61-42043 |
| Mar. 22, 1986 | [JP] | Japan | 61-42044 |
| May 19, 1986 | [JP] | Japan | 61-75111 |
| May 19, 1986 | [JP] | Japan | 61-75112 |

[51] Int. Cl.[4] ..... B63H 1/26

[52] U.S. Cl. ..... 416/235; 415/119; 416/223 R

[58] Field of Search ..... 416/235, 236 A, 236 R, 416/231 R, 223 B, 223 R; 415/119; 181/206; 354/309; 355/30

[56] References Cited

U.S. PATENT DOCUMENTS

| | | | |
|---|---|---|---|
| 1,531,967 | 3/1925 | MacMillan | 416/236 R |
| 2,238,749 | 1/1939 | Peltier | 416/235 |
| 3,481,531 | 12/1969 | MacArthur et al. | 416/236 R |

FOREIGN PATENT DOCUMENTS

| | | | |
|---|---|---|---|
| 587176 | 10/1933 | Fed. Rep. of Germany | 416/236 |
| 372378 | 5/1932 | United Kingdom | 416/236 |
| 580806 | 9/1946 | United Kingdom | 416/235 |

*Primary Examiner*—Robert E. Garrett
*Assistant Examiner*—Therese M. Newholm
*Attorney, Agent, or Firm*—Anthony J. Casella; Gerald E. Hespos

[57] ABSTRACT

Each blade (2) of a propeller fan projecting radially outwardly from the outer peripheral surface of an annular boss (1) has on at least part of its suction side (3), a coarsened surface (4).

10 Claims, 4 Drawing Sheets

PRIOR ART

BLADES FOR PROPELLER FAN

This application is a continuation of Application Ser. No. 134,007 filed on Dec. 17, 1987, which in turn was a continuation of Application Ser. No. 027,653, which was filed on Mar. 19, 1987 both now abandoned.

This application is related to U.S. patent application Ser. No. 219,452 entitled "BLADES FOR LOW SPEED PROPELLER FAN" and U.S. patent application Ser. No. 219,390 entitled "BLADES FOR HIGH SPEED PROPELLER FAN", both of which were filed on the same day as the subject application.

This invention relates to blades for a propeller fan more particularly, fan blades such as used for supplying air to automobile engines or other kinds of apparatus for cooling or other purposes, and which is made of, for example, a resin or metal.

Two examples of known propeller fans are shown in FIGS. 12 and 13. Each of the fans comprises a boss 11 having an outer peripheral surface and a plurality of blades 12 projecting radially outwardly from the outer peripheral surface of the boss 11. Each blade 12 of the fan shown in FIG. 11 has a multiplicity of apertures 14 extending therethrough between its longitudinal centreline and its rear edge 13. The apertures 14 allow air to flow therethrough and thereby reduce the pressure difference between the suction and delivery sides of the blade 12 so as to avoid substantial separation of the boundary layer flow along the suction side surface of the blade 12, as such separation produces a noise. The blade 12 shown in FIG. 12 has a plurality of notches 15 along its rear edge 13. The notches 15 prevent the formation of a large turbulent flow or air at the rear edge 13 and thereby reduce the noise which the fan produces.

The propeller fan when it is driven produces noise mainly caused by the sound of the separating air, the sound of the flowing air and the sound of the pitching air. The sound of the separating air is due to a turbulent flow of air which is generated by the separation of air in a boundary layer from the blade surface, as hereinabove described. There exist two flows of air along the surface of each blade on the suction side, i.e. an outer flow of air having a high velocity which is substantially constant, and an inner flow of air (boundary layer) contacting the blade surface and having a low velocity and a small amount of kinetic energy which is due to the viscosity of air. The boundary layer thickness increases with an increase in air velocity and toward the rear edge of the blade and is eventually separated from the blade surface to form eddies.

Neither of the known fans referred to is very effective in preventing noise including the sound of the separating air. Moreover, the apertures or notches reduce the effectiveness of the fan and the mechanical strength of the blade per se.

One object of this invention to provide blades for a propeller fan which can effectively overcome the drawbacks of the prior art as hereinbefore pointed out.

We have now found that if at least a portion of the suction side surface of each blade is coarsened, the air in the boundary layer is agitated so producing a finely divided swirling flow of air which mixes with the outer layer so imparting considerable kinetic energy to the boundary layer. This reduces the thickness of the boundary layer and prevents or at least delays its separation.

The degree of which the boundary layer is agitated by the coarsened surface depends on the density and depth of the indentations defining the coarsened surface and the velocity of the air. The velocity of the air at any particular point on each rotating blade is proportional to its radial distance from the centre of the fan toward the radially outer end of the blade, the air has a higher velocity and the boundary layer is agitated more strongly to increase a finely divided swirling flow of air which moves into the outer layer. Therefore, if each blade has a coarsened surface on at least a portion of its surface on the suction side, or a coarsened surface defined by indentations having a density or depth which increases from the radially outer end of the blade to its radially inner end, it is possible to prevent substantially a large swirling flow of air from appearing due to the separation of air from the blade surface on the suction side and thereby reduce the noise of the fan without lowering the air supplying capacity of the fan or the mechanical strength of the blade per se.

In accordance with the invention, we propose the blades for a propeller fan which includes a member connected to a rotating body and having an outer peripheral surface and a plurality of blades projecting radially outwardly from the outer peripheral surface, wherein each of the blades has on at least part of its suction side, a coarsened surface.

Preferably, the coarseness of the surface increases from the radially outer end of the blade to its radially inner end. The coarsened surface may be a grooved surface or a roughened surface or a combination thereof.

Embodiments of the invention will now be described by way of example with reference to the accompanying drawings in which.

Figure 1:
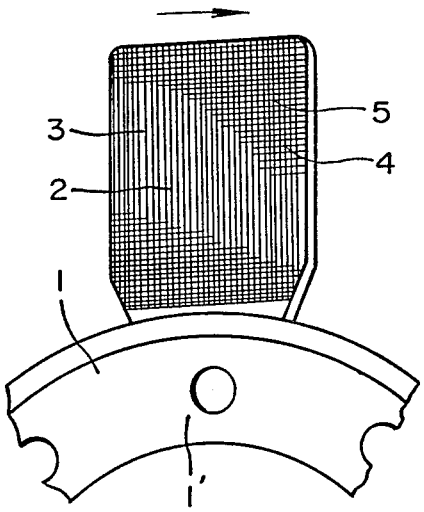
FIG. 1 is a fragmentary front elevation of a propeller fan.
Figure 2:
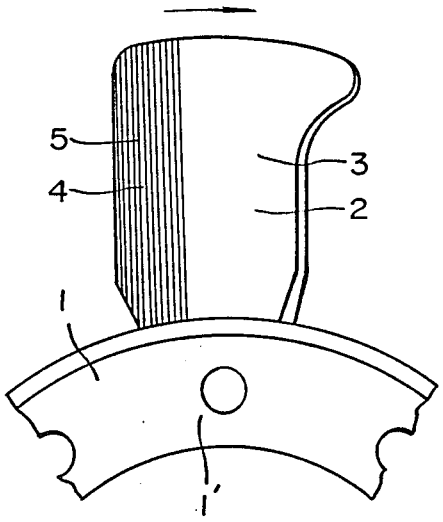
FIG. 2 is a view similar to FIG. 1, but showing another embodiment of this invention.
Figure 3:
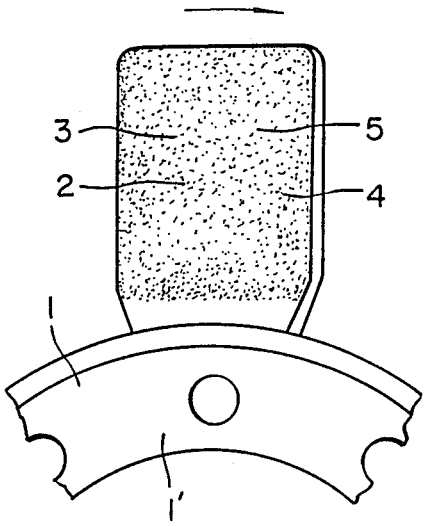
FIG. 3 is a view similar to FIG. 1, but showing still another embodiment.
Figure 4:
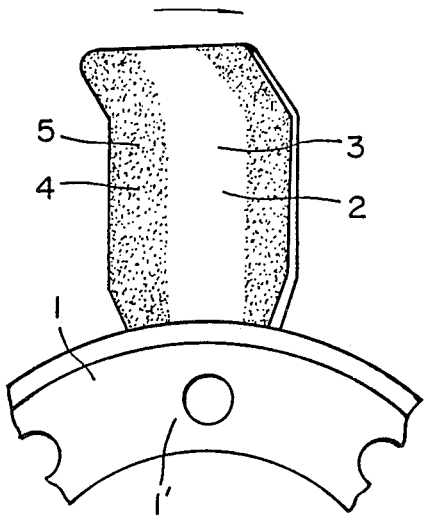
FIG. 4 is a view similar to FIG. 1, but showing still another embodiment.

The fans shown in FIGS. 1 to 4, each comprise an annular boss 1 having an outer peripheral surface and a mounting wall 1' at which it is connected to a rotating body (not shown), and a plurality of blades 2 projecting radially outwardly from the outer peripheral surface of the boss 1. The fan may, for example, be made of a synthetic resin or soft metal such as aluminum or aluminum alloy. Each blade has a finely coarsened surface 4 which covers its surface 3 on the suction side totally as shown in FIG. 1 or 3, or partly as shown in FIG. 2 or 4. When only part of the surface 4 is coarsened, it may, for example, be along the front, rear, or radially outer edge of the blade 2, or a longitudinally central portion thereof. The coarsened surface 4 may be formed by a multiplicity of fine grooves 5 as shown in FIG. 1 or 2, or may be a roughened surface 5 as shown in FIG. 3 or 4. The grooves may extend parallel to one another, or may intersect one another to form a network, or may define an irregular pattern.

The coarsened surface 4 of the blades preferably has a roughness of, say, 5 to 300 μm and, in the embodiment of FIGS. 1 and 2, can be formed by rubbing sandpaper or a wire brush against the surface 3 of the blade 2 as moulded. Alternatively, the mould may have a finely grooved inner surface. FIG. 3 and 4 show a coarsened surface 4 formed by sand blasting the surface 3 of the blade 2 as moulded, or by using a mould having a finely satinishing inner surface. It is, of course, possible to form a combined grooved or satinished blade surface.

Figure 5:
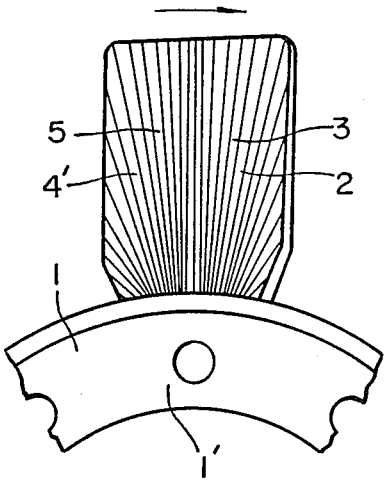
FIG. 5 is a view similar to FIG. 1, but showing still another embodiment.
Figure 6:
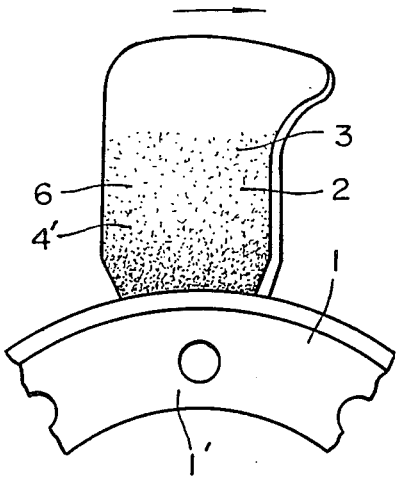
FIG. 6 is a view similar to FIG. 1, but showing a further embodiment of this invention.
Figure 7:
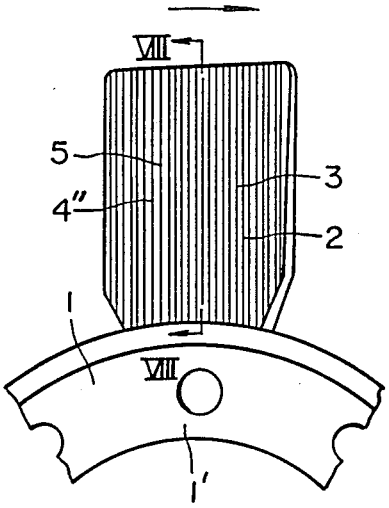
FIG. 7 is a view similar to FIG. 1, but showing a still further embodiment.
Figure 8:
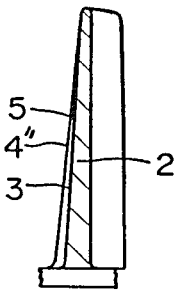
FIG. 8 is a cross-section taken along the line VIII—VIII of FIG. 7.
Figure 9:
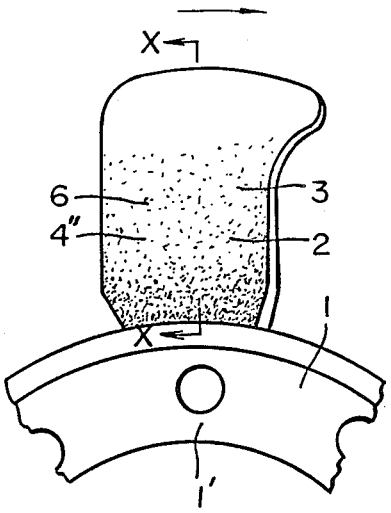
FIG. 9 is a view similar to FIG. 1, but showing a still further embodiment.
Figure 10:
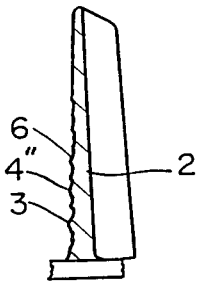
FIG. 10 is a cross-section taken along the line X-X of FIG. 9.
Figure 12:
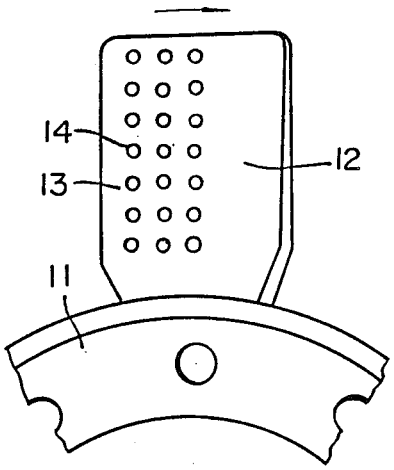
FIG. 12 is a fragmentary front elevation of a propeller fan known in the art.
Figure 13:
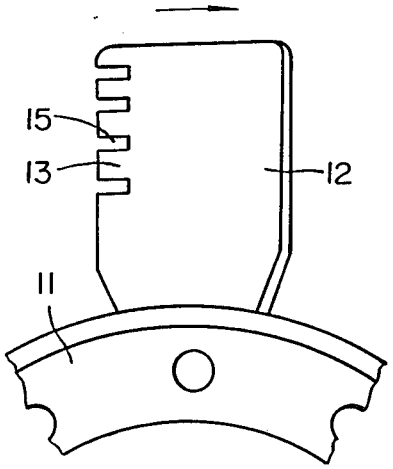
PRIOR ART Fig. 13
FIG. 13 is a fragmentary front elevational view of another propeller fan known in the art.

Each of the blades 2 shown in FIGS. 5 and 6 is similar to the blades shown in FIGS. 1 to 4, but differs therefrom in that the density of the coarsened surface 4' gradually increases from the radially outer end of the blade 2 to its radially inner end.

Each of the blades 2 shown in FIGS. 7 to 10 is also similar to the blades shown in FIGS. 1 to 4, but differs therefrom in that the depth of the features making up the coarsened surface 4'' (i.e. the coarsening thereof) gradually increases from the radially outer end of the blade 2 to its radially inner end.

An arrow shown in each of the Figures indicates the direction of rotation of the propeller fan.

The foregoings are the embodiments relating to the propeller fan comprising an annular boss 1 having a mounting wall 1' for connecting the annular boss to a rotating body and a plurality of blades 2 formed integrally with the annular boss.

Figure 11:
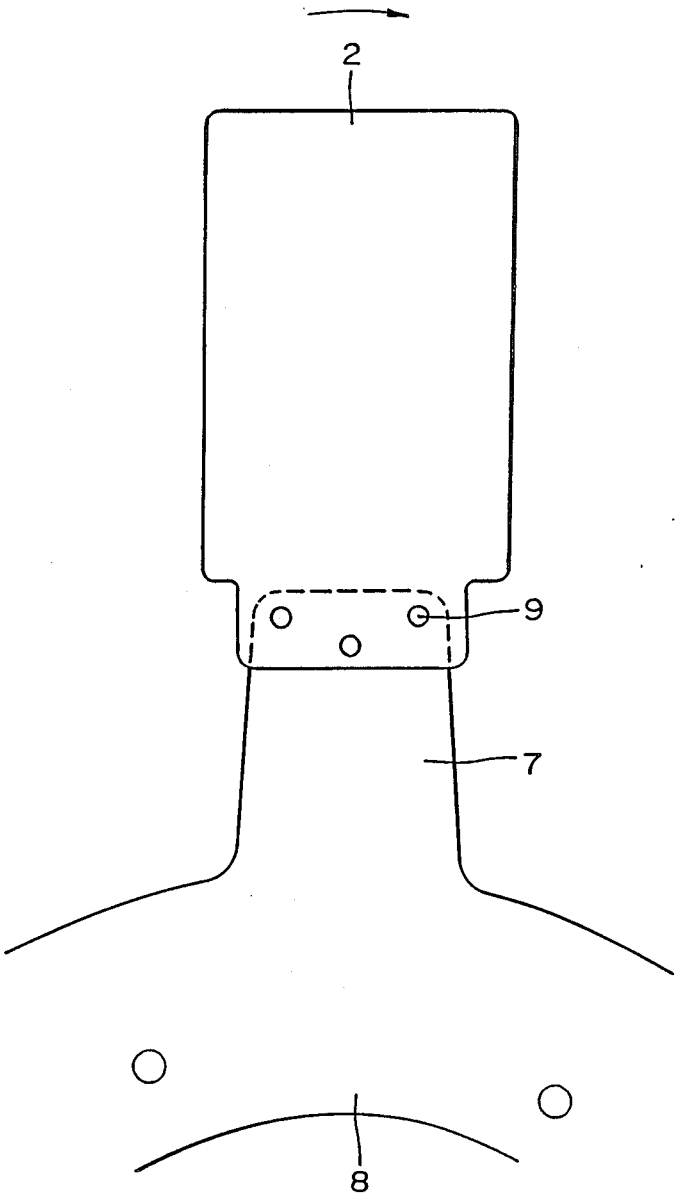
FIG. 11 is a view similar to FIG. 1, but showing a still further embodiment.

The invention is not restricted to such the embodiments as above mentioned. The propeller fan may be constructed with, for example, as shown in FIG. 11, a spider 7 having a mounting wall 8 for connecting the spider to a rotating body and a plurality of blades 2 formed independently of the spider, wherein the blades are fixed to the spider by rivets 9 or likes. In case that the blades are made of a synthetic resin or soft metal, they may be mould to have a blade insert which is to be fixed to the outer periphery of the spider by the rivets or likes. In case that the blades are made of a hard metal such as iron, they may be provided with a coarsened surface which can be formed by rubbing sandpaper or wire brush against the surface coated previously with a paint or coating the surface with a paint mixed with fine particle material or spraying the fine particle material onto the surface which was previously coated with an adhesive agent.

The coarsened surface 4, 4' or 4'' serves to agitage the air in the boundary layer along the surface 3 of each blade 2 and thereby mix therewith at relatively high kinetic energy in the outer layer. Therefore, it is possible to divide finely a large swirling flow of air otherwise resulting from the separation of air from the blade surface 3 and impart a large amount of kinetic energy to the boundary layer to reduce its thickness so that the separation of air from the blade surface may be prevented or at least delayed.

The extent to which the boundary layer is agitated by the coarsened surface depends on the density or depth of the indentations defining the coarsened surface and the velocity of air flowing in the boundary layer. The velocity of the air flowing at any point on each blade is proportional to its radial distance from the centre of the fan. As the point reaches the radially outer end of the blade, the air has a higher velocity and the boundary layer is agitated more strongly to increase a finely divided swirling flow of air which moves into the outer layer. Therefore, if the coarsened surface has a coarsened density or depth which increases from the radially outer end of each blade to its radially inner end, there is a more significant reduction in noise of the fan as any large swirling flow of air resulting from the separation of air from the blade surface can be decreased or finely divided.

An important advantage of the invention is the ability to provide very useful blades for a propeller fan which is easy to manufacture without calling for any essential change in construction of the blades and without lowering the capacity of the fan or the mechanical strength of the blades per se.

I claim:

1. In a propeller fan which includes a member connected to a rotating body and a plurality of blades extending radially outwardly from the outer peripheral surface of said member, each of said blades characterized by having a coarsening on at least part of its suction side, said coarsening extending greater depths into the suction side at radially inwardly disposed locations on the blades.

2. A fan according to claim 1, wherein the coarsened surface is defined by fine grooves.

3. A fan according to claim 1, wherein the coarsened surface is defined by an irregular roughness.

4. A fan according to claim 1, wherein the coarsened surface is a combined grooved and roughened surface.

5. A fan according to claim 4, wherein the coarsened surface has a roughness of 5 to 300 μm.

6. A fan according to claim 1, wherein the coarsened surface has a coarsened density which gradually increases from the outer end to the inner end.

7. A fan according to claim 6, wherein the coarsened surface is defined by fine grooves.

8. A fan according to claim 6 wherein the coarsened surface is defined by a roughening of the surface.

9. A fan according to claim 6 wherein the coarsened surface is a combined grooved and roughened surface.

10. In a propeller fan which includes a member connected to a rotating body and a plurality of blades extended radially outwardly from the outer peripheral surface of said member, each of said blades characterized by having an irregularly roughened surface on at least part of its suction side, the density of roughening on said surface gradually increasing from the radially outer end of the blade to the radially inner end thereof.

* * * * *